United States Patent [19]

Foster et al.

[11] Patent Number: 4,889,049

[45] Date of Patent: Dec. 26, 1989

[54] WRINGER DEVICE

[76] Inventors: Stephen R. Foster, 918 Nashville Ave., New Orleans, La. 70115; Thomas R. Oschmann, 4951 Bundy Rd., New Orleans, La. 70127

[21] Appl. No.: 237,721

[22] Filed: Aug. 29, 1988

[51] Int. Cl.[4] ..... B30B 3/04

[52] U.S. Cl. ..... 100/171; 68/99; 68/126; 68/257; 68/269 B; 68/273; 100/172; 100/176

[58] Field of Search ..... 68/99, 126, 236, 238, 68/239, 244, 257, 269 R, 269 B, 272, 273; 100/121, 155 R, 169, 171, 172, 176; 15/262; 74/17

[56] References Cited

U.S. PATENT DOCUMENTS

| | | | |
|---|---|---|---|
| 76,004 | 3/1868 | Thompson | 68/99 |
| 137,494 | 4/1873 | Smith | 68/99 |
| 141,044 | 7/1873 | Glines | 68/99 |
| 170,818 | 12/1875 | Cilley et al. | 68/99 X |
| 175,950 | 4/1876 | Duncan | 68/126 X |
| 185,933 | 1/1877 | Karr | 68/99 |
| 201,224 | 3/1878 | Calef | 68/99 |
| 1,200,965 | 10/1916 | Miller | 68/99 |
| 1,262,414 | 4/1918 | Uhrig et al. | 74/17 |
| 1,484,003 | 2/1924 | Bennett | 100/172 X |
| 1,703,422 | 2/1929 | Hedges | 68/272 |
| 2,228,853 | 1/1941 | Skinner | 68/99 |

FOREIGN PATENT DOCUMENTS

| | | | |
|---|---|---|---|
| 4754 | 9/1878 | Fed. Rep. of Germany | 100/176 |
| 605786 | 7/1948 | United Kingdom | 68/244 |

*Primary Examiner*—Philip R. Coe

*Attorney, Agent, or Firm*—Hubbard, Thurman, Turner & Tucker

[57] ABSTRACT

An improved wringer device is provided for squeezing water from a cloth or chamois when fed between a pair of adjacent rollers. Each roller is made from thermoformed plastic, or molded elastomeric material with an outer surface defining a plurality of axially aligned curvilinear hill and valley surfaces. The hill surface of one roller meshes with a valley surface of the adjacent roller to assist in feeding the cloth through the rollers and to maximize efficiency by minimizing required cranking force. The device includes a first support member for mounting to a wall, a second roller support member selectably connected to the first member, and a third roller support member fixedly secured to the second member, a pair of rollers with substantially parallel axes and each supported between the second and third support members, and a crank interconnected with one of the rollers to drive that roller, which then drives the other roller. Each support member is preferably fabricated from injection molded plastic, and may be structurally indentical to reduce tooling and manufacturing costs.

12 Claims, 1 Drawing Sheet

WRINGER DEVICE

FIELD OF THE INVENTION

The present invention relates to devices for squeezing liquid from an absorbant sheet-like material and, more particularly, to an improved wringer device of the type suitable for mounting to a surface for wringing water from a cloth or chamois used in cleaning a vehicle or household items.

BACKGROUND OF THE INVENTION

Various techniques have long been employed to extract water from a cloth or chamois. When washing or drying a vehicle, for example, people frequently twist the cloth with their hands in a wringing motion to remove excess water and then straighten the cloth by spreading it and shaking it back to its original sheet-like shape which typically results in dropping the cloth to the ground. This technique, although both inefficient and a nuisance, is commonly employed since reliable, efficient, and cost effective devices for better accomplishing this task are not available, or have not been widely accepted due to their expense and/or complexity.

Washing machines from the 1930–1950's era often employed rollers for wringing water from clothes before drying, with the cloth being forcibly sandwiched between adjacent rollers. These wringing mechanisms were typically mounted on a post atop the washing machine adjacent the washer tub, and were powered by a small electric motor. These wringing devices did not efficiently remove excess water from the cloth and were difficult to operate, partially because the cloth tended to get bunched, and the rollers smooth when wet, so that the cloth would not feed between the roller, and often had to be pulled through by the operator while the powered rollers were activated. This powered drive mechanism presented a significant safety risk to fingers when a cloth became bunched between the rollers, since one's fingers were closely adjacent the powered rollers during attempts to "spread out" the bunched cloth to eliminate the feed-through problem. Accordingly, present day washers typically utilize the centrifugal action of a spinning container to safely remove excess water from cloth. Such spinners can, however, be easily abused by uncaring individuals. Automatic shutoff mechanisms can be overridden, and such devices generally are offered for use by the general public only when sufficient usage justifies a full time employee to oversee operation of numerous such spinners.

Accordingly, neither of the above-described mechanisms are well suited for continued use in an outdoor environment particularly by relatively inexperienced personnel. These prior at mechanisms are expensive to manufacture, and costly to maintain. While some car washing operations may be sufficiently large to justify an employee to "spin dry" towels used by other employees to dry cars, patrons of most self-service car washing operations continue to manually wring out towels and chamois. Similarly, individuals who wash their cars at home cannot justify the expense and/or location inconvenience of currently available equipment to eliminate water from towels and chamois.

The disadvantages of the prior art are overcome by the present invention, and an improved mechanism is hereinafter provided for inexpensively, reliably and safely removing water from a cloth, chamois, or similar sheet-like absorbant material.

SUMMARY OF THE INVENTION

A wringing device according to the present unit is hand-powered, and can be easily mounted to a wall or similar substantially vertical surface adjacent a house, apartment, R-V, carwash building, or other outdoor structure where it is desirable to conveniently and inexpensively, yet efficiently, remove liquid from an absorbant cloth-like material. The device of the present invention is formed from plastic components, and accordingly does not rust or deteriorate with repeated exposure to sunlight or water. The device can be safely operated by inexperienced personnel, both because of its handpowered operation and because problems associated with feeding the cloth or absorbant material through the rollers have been substantially eliminated.

The wringing unit comprises first and second rollers having substantially parallel axes with both ends of one of the rollers radially movable away from the other roller during the cloth feeding operation, while also being biased toward the roller by a rubber-like member. The rollers are mounted between a pair of plastic-material support members rigidly interconnected with one roller being rotatably mounted at a fixed location with respect to each support member, and the other roller being rotatably mounted within an end block which is movable within its respective support member. A plasticmaterial wall mounting support member is provided for securing the unit to the wall, with the roller support members and the rollers being pivotably movable as a subassembly about the wall-mounted support. Each of the three support members may be structurally identical, and formed from injection molded or otherwise thermoformed plastic to reduce manufacturing costs.

Each roller is also preferably fabricated from an extruded or otherwise thermoformed plastic material or molded rubber-like plastic material, and comprises an inner hub, a sleeve-shaped outer member including exterior wringing surfaces, and a plurality of ribs for interconnecting the hub and the outer member. An alternate method of roller construction would be of a solid molded rubber-like material wherein interconnecting ribs would not be present. The exterior wringing surface of each roller defines a plurality of curvilinear hills and valleys respectively rising radially outwardly and falling radially inwardly from the nominal outer diameter of the roller. The hill surface of one roller meshes with the valley surface of the second roller, so that the wringing surfaces of both rollers are closely adjacent to efficiently squeeze water from a cloth passing between the rollers. The curvilinear exterior surfaces of the rollers substantially assist in feeding the cloth through the rollers, reduce the effort required to efficiently squeeze water from the cloth when rotating the crank, increase the structural integrity of each roller, and positively drive or rotate both rollers independently of frictioned engagement provided by the sandwiched cloth, eliminating cloth slippage and the need for gears.

It is thus a feature of the present invention to provide an improved wringing device suitable for a variety of indoor and outdoor uses to economically squeeze water from a cloth, chamois, or similar absorbant fabric-like material.

It is a further feature of the present invention to provide an improved wringer device which does not rust or deteriorate upon prolonged exposure to sunlight and water.

It is a further feature of the present invention to provide an inexpensive yet reliable wringer device which can be safely operated by relatively inexperienced personnel.

These and further features and advantages of the present invention will become apparent from the following detailed description, wherein reference is made to the figures in the accompanying drawings.

DETAILED DESCRIPTION OF PREFERRED EMBODIMENTS

Figure 1:
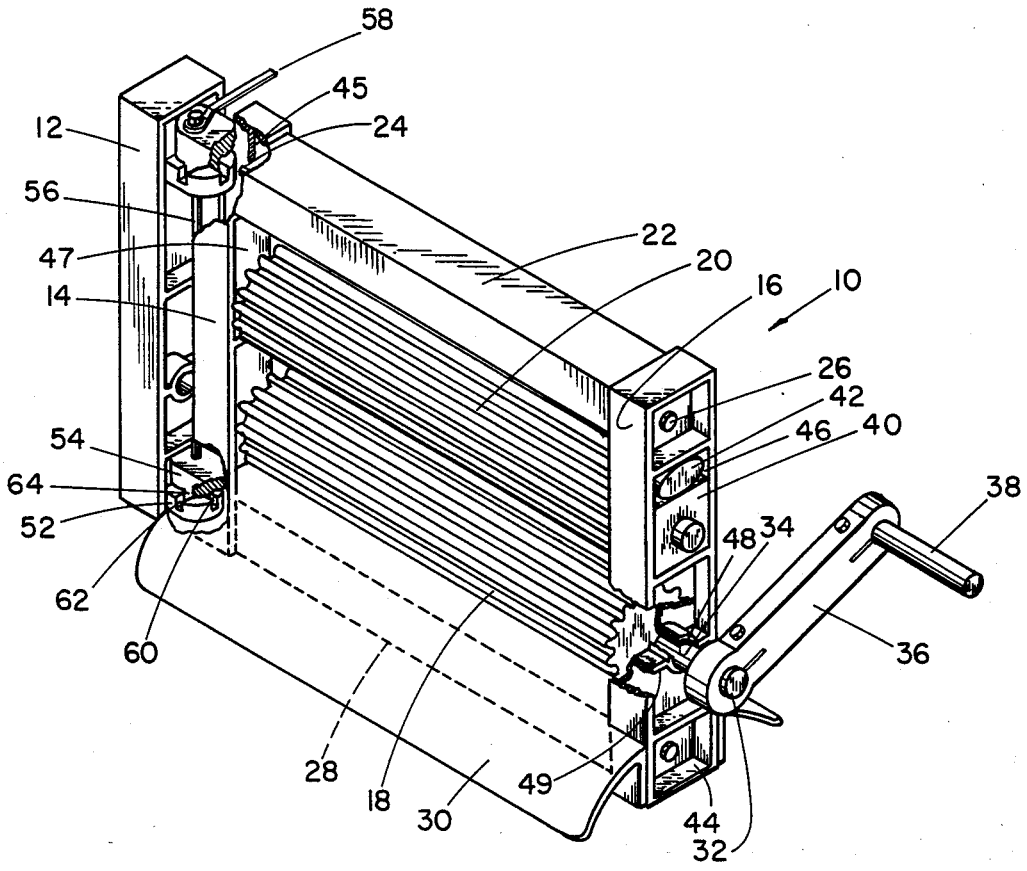
FIG. 1 is a pictorial view, partially in cross section of a wringing device according to the present invention.

The wringer unit 10 shown in FIG. 1 comprises a first support member 12 for mounting to a wall or similar structure (not shown), and second and third support members 14, 16 for rotatably supporting a pair of rollers 18, 20 therebetween. Each of the support members 12, 14, 16 may be fabricated from a plastic material, such as that commercially available under the trade name "ZYTEL", by an economical injection molding process or the like. Accordingly, each of the support members may be structurally identical to reduce manufacturing costs and inventory for replacement parts. As shown in FIG. 1, each support member has a right angle parallel piped configuration. This design provides a substantially flat rectangular surface for the support member 12 for rigid engagement with the wall, and allows for the formation of rectangular-shaped cavities discussed subsequently.

The support members 14 and 16 are held in fixed relationship by an upper tubular member 22 and a lower tubular member 28 each having a substantially rectangular cross-sectional configuration. Each of the members 22, 28 has a rod-like member 24 passing therethrough and through an aperture provided in the supports 14, 16, so that a pair of nuts 26 threaded to the ends of the rods effectively sandwich the members 22, 28 between the supports, thereby creating a rigid rectangularshaped frame for mounting the rollers. Between the lower roller 18 and the lower member 28 is a unitary deflector 30. Deflector 30 sheds water being squeezed from between the rollers during the wringing operation and provides lateral rigidity to the wringer unit to inhibit deflection while cranking the rollers. If desired, one side of the deflector 30 may have a generally downward-shaped trajectory, with the opposite side having a slight ledge or upward-shaped trajectory, so that all the water coming from between the rollers would essentially fall off one side of the unit 10.

Each of the rollers 18, 20 is preferably identical, and includes a central hub, a sleeve-shaped exterior body, and a plurality of rib members interconnecting the hub and exterior body. A shaft is provided at each end of the roller for supporting the roller, and may be easily formed by removing the exterior body and plurality of rib members from a selected length of extruded roller, so that only the central hub remains at each end of the roller, with the hub then being turned to form a shaft. This technique again reduces the cost of manufacturing the rollers since rollers may also be formed by an extruding process, and also enables each roller to be easily manufactured with a shaft of a desired length at each end. It should also be clearly understandable that the rollers may be produced by alternative methods such as molding either by plastic foam process or a solid rubber-like material injection process. As shown in FIG. 1, roller 18 has an elongated shaft 32 at one end which passes through a cylindrical-shaped passageway 34 in the support 16. The other end of the roller 18 and both ends of the roller 20 may have a comparatively shorter shafts provided for rotatably mounting that end of each roller, while shaft 32 is extended for both rotatably mounting the roller and for receiving the crank arm 36 having a handle 38 thereon. It should thus be understood that the shaft of roller 18 opposite shaft 32 is fixedly positioned within a similar passageway 34 (not shown) within the support member 14, and thus the roller 18 is fixedly mounted within respect to the rectangular-shaped frame, and can be manually driven by rotating the crank arm 36.

Each end of roller 20 is rotatably mounted within a rectangular-shaped bearing block 40, which has a shaft-receiving passageway and is slidably positioned within a suitable cavity in the respective members 14, 16. An elastomeric material 42 is sandwiched between a horizontal stop surface on each of the members 14, 16 and the respective bearing block within that support member. Accordingly, both ends of the roller 20 are free to move radially (upwardly) with respect to the fixed axis of the roller 18, but this upward movement is opposed by the elastomeric members 42 which bias each block and thus the ends of the roller 20 downward. This simple yet highly effective technique allows the axes of the rollers to separate when passing a relatively thick cloth or chamois between the rollers, yet also ensures that the cloth or chamois being passed therethrough will be subjected to a significant compressive force. Also, the components used to achieve this function and benefit may be fabricated entirely from plastic or elastomeric materials, and accordingly are not subject to rust or corrosion, and results in low friction between sliding surfaces.

Each of the support members includes a pair of structurally identical upper and lower cavities 44 each having a vertical central rib 45 therein, which in turn has an aperture (not shown) for receiving an end of the rod 24. An end of each of the members 22, 28 is thus configured to fit snugly within the rectangular-shaped cavity 44 and against central rib 45. The aperture in each rib 45 may be used in support member 12 as a passageway for receiving a bolt, screw, or other conventional device for fixedly mounting support 12 to a wall.

Each support member has a second cavity 46 defined by a pair of horizontal plates and an interior rib 47 having a vertical slot (not shown) for receiving the ends of roller 20. The cavity 46 is sized for receiving a bearing block 40 and a biasing member 42 therein. Finally, each support member has a sleeve-shaped component 48 which defines the interior cylindrical surface 34 for receiving a shaft end of roller 18. The component 48 may be suitably supported by a plurality of rib-like members 49.

The ringer may have a rectangular frame defined by the members 14, 22, 16, and 28, as well as the interconnected components (which primarily include the rollers 18, 20 and the deflector 30), are free to be manually pivoted as a unitary subassembly with respect to the wall mounted support 12. For this purpose, a female half 52 of a hinge is fixedly positioned within the upper and lower cavities 44 of the member 12, with a similar male half 54 being positioned within the same cavity of the support member 14. Each female half includes a pair of crossing slots 60, 62, while each male component 54 including a linear ridge 64 intended to fit within one of the slots 60 or 62, and thereby lock the rectangular frame either in a position substantially parallel with and against the wall (when not in use) or in a position substantially perpendicular to the wall (for normal operation). A vertical hinge pin 56 runs through the aligned apertures in each of the male and female hinge halves in order to facilitate this pivoting motion. A toggle member 58 is provided for locking the rectangular frame within one of the two positions described above. In other words, with the toggle in the locked position, the rectangular frame cannot be lifted vertically with respect to the wall support 12 and the unit is thus locked in place. When the toggle handle 58 may be rotated 90 degrees, an operator may lift the rectangular framework to rotate the subassembly to its other position, then rotate the toggle handle 58 to lock the unit in that position.

Figure 2:
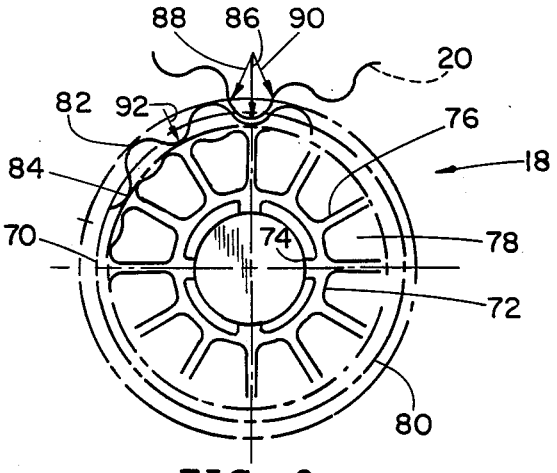
FIG. 2 is an end view of a suitable roller for use in the wringer device of the present invention.

FIG. 2 depicts an end view of a suitable roller 18 according to the present invention, and also illustrates the relationship between lower roller 18 and an upper roller 20 when positioned for receiving a cloth or chamois therebetween. The roller 18 includes a sleeve-shaped central hub 72 having a plurality of radially inward directed projections 74 for enhancing structural integrity. Thus hub 72 may be "turned down", as described above, to form a shaft end of each roller having a desired length. The roller 18 also includes a sleeveshaped exterior body 70 fixed to the hub 72 by a plurality of radially-directed rib-like members 76 each separated by cavity 78. The outer cylindrical body 70 has a nominal or average diameter 80, with its outer surface comprising a plurality of interconnected hill surfaces 82 and valley surfaces 84 each respectively extending radially outwardly and inwardly from the diameter 80. It should be understood that the roller 18 includes hill and valley surfaces extending around the periphery thereof, so that each quadrant of the roller is identical to the upper left-side quadrant shown in FIG. 2. Each hill surface and valley surface is preferably arcuately-shaped, with a radius 92 preferably in the range of from 0.1 inches to 0.2 inches. The arcuate shape of a hill surface thus intersects the arcuate shape of a valley surface at a point closely adjacent to the location of the nominal diameter 80, with a tangent of each surface at that point being substantially identical. As previously indicated, each roller is preferably fabricated from a plastic material by an extruding process, and thus each hill surface 82 and valley surface 84 is parallel with the axis of the roller.

This cross-sectional undulating curvilinear design formed by the hills and valleys of each roller also substantially increases the structural integrity of the roller and, more particularly, the outer sleeve portion 70. Thus the roller 18 as shown in FIG. 2 is less susceptable to cracking or other failure than would be a roller with a V-shaped series of outer surfaces, or a roller which was not formed as a unitary member.

The design of the rollers according to the present invention substantially increases the effectiveness of squeezing water from a cloth or chamois with a reduced torque input. Minimizing material used in construction also minimizes cost. Vectorial analysis shows that opposing forces represented by the vector 86 directed between the axes of the rollers are achieved, which forces would be substantially the same if the rollers had a cylindrical outer configuration. The roller design of the present invention is, however, a significant improvement over rollers with a cylindrical configuration in that vector forces 88 and 90 are also created as the hill surface of one roller meshes with the valley surface of the other roller. The forces 88 and 90 produce significant radially directed forces and these forces oppose each other, thus they do not adversely increase the torque required to rotate the rollers relative to each other. Thus a significantly improved squeezing force is achieved according to the present invention as opposed to the traditional straight cylindrical roller design, providing increased efficiency by reduced torque requirement and minimized loads placed on the bearing assemblies and overall structure.

FIG. 2 illustrates that rotation of one roller by a crank necessarily drives or rotates the other roller. Also, the curvilinear design of the roller surfaces creates a wedge which continues to vary in geometry as the rollers are driven. This varying wedge has the affect of "grabbing" the towel or chamois to better feed the sheet-like material between the rollers, rather than having the material jam between the rollers or allowing the material to slip along the roller surface (but not be fed between the rollers) as the rollers rotate.

In the embodiment as shown in FIG. 1, the manually manipulatable crank drives the lower roller, which is the roller with its axis fixed relative to the support members 14, 16. This design is believed to be preferable since the axis of the roller being cranked does not move depending on the thickness of the cloth or chamois being passed through the rollers. It is, however, within the concept of the present invention that the crank could be provided on the "floating" roller 20.

Since all or substantially all of the components for the wringer unit 10 may be formed from plastic, the unit is economical to manufacture, easy to install or mount on any vertical wall, and inexpensive to maintain. The unit may be safely operated by the general public, and is not damaged by prolonged exposure to sunlight and/or water. Various pivoting mechanisms or other securing mechanisms may be employed to secure the rectangular-shaped frame to the wall support 12.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A wringer unit for squeezing liquid from an absorbant sheet-like material when sandwiched between first and second roller members having substantially parallel axes and each having a uniform nominal diameter, the wringer unit comprising:

a first plastic-material support member having a planar face surface for rigidly mounting the first support member to a surface;

a second plastic-material support member connected to the first member and having a first cylindrical-shaped interior receiving member extending through the second support member for rotatably receiving an end of the first roller, and having a second receiving member extending through the second support member for supporting an end of the second roller;

a third plasticmaterial support member fixedly interconnected with the second support member and having a third cylindrical-shaped interior receiving member extending through the third support member for rotatably receiving another end of the first roller, and having a fourth receiving member through the third support member for supporting another end of the second roller;

a first block mounted within the second receiving member for rotatably receiving the end of the second roller, such that the first end of the second roller can move radially within the second receiving member with respect to the axis of the first roller;

a second block mounted within the fourth receiving member for rotatably receiving the another end of the second roller, such that the another end of the second roller can move radially within the fourth receiving member with respect to the axis of the first roller;

first and second biasing members for biasing the ends of the second roller toward the axis of the first roller; and a crank arm fixedly connected to the first or second roller for rotating the first or second roller, each of the first and second roller members each having a plurality of exterior curvilinear hill surfaces each radially outward from a nominal diameter of each roller member and a plurality of exterior curvilinear valley surfaces each radially inward from the nominal diameter of each roller member, such that the hill surfaces of the first roller member mesh with the valley surfaces of the second roller ember, and the valley surfaces of the first roller mesh with the hill surfaces of the second roller member.

2. The wringer unit as defined in claim 1, wherein each of the hill surfaces and valley surfaces has an arcuate portion with a specified radius of its own.

3. The wringer unit as defined in claim 2, wherein each arcuate portion of each hill surface and valley surface is substantially symetrical about a crown of each hill surface and a base of each valley surface, respectively.

4. The wringer unit as defined in claim 1, further comprising a means for rigidly attaching each of the pair of roller support members to at least one surface, whereby the first and second roller members remain substantially parallel to the surface and stand off from the vertical surface a sufficient distance to allow clearance for a crank handle attached to an operators hand for full 360 ° rotation of either of the rollers.

5. The wringer unit of claim 1 further comprising:

the second support member and a third support member each having upper and lower through apertures;

upper and lower plastic-material tubular spacer members each positioned between the second and third support members; and upper and lower rod members each passing through a respective upper or lower tubular space member and through a respective aperture of the second and third support members for interconnecting the second and third support members.

6. The wringer unit of claim 1, wherein:

each of the first and second blocks has a cylindrical-shaped interior receiving member for rotatably receiving the first end and the another end of the second roller, respectively; and each of the first and second blocks are slidably movable within the second and fourth receiving members, respectively, of the second and third support members.

7. The wringer unit of claim 6 wherein the first and second rollers are each spaced between the upper and lower spacer members, such that the upper and lower spacer members and the second and third support members define a substantially rectangular-shaped frame about the first and second rollers.

8. The wringer unit of claim 1 wherein the first and second biasing members are comprised of elastomeric material.

9. The wringer unit of claim 1 wherein:

the third cylindrical-shaped interior receiving member passes through the third support member;

the another end of the first roller passes through the third interior receiving member and the crank arm is fixedly connected to the another end of the first roller.

10. The wringer unit of claim 1 wherein each of the first, second and third support members has a right angle parallelepiped configuration.

11. The wringer unit of claim 1, further comprising:

the first biasing member being positioned adjacent to the end of the second roller for biasing the end of the second roller toward the axis of the first roller; and a second biasing member being positioned adjacent to the another end at the second roller for biasing the another end of the second roller toward the axis of the first roller.

12. The wringer unit of claim 1 further comprising means for rigidly attaching at least one of the pair of roller support members to at least one surface whereby the unit is selectively removable from the surface by upward thrust applied to the unit.

* * * * *